US005342229A

United States Patent [19]

Whitt

[11] Patent Number: 5,342,229

[45] Date of Patent: Aug. 30, 1994

[54] FLOAT TUBE ANCHOR APPARATUS

[76] Inventor: Leonard A. Whitt, 330 Park Ave., Vista, Calif. 92084

[21] Appl. No.: 75,604

[22] Filed: Jun. 14, 1993

[51] Int. Cl.[5] ..... B63B 21/52

[52] U.S. Cl. ..... 441/6; 114/294

[58] Field of Search ..... 441/6, 23–28; 114/300, 304, 305; 43/44.9

[56] References Cited

U.S. PATENT DOCUMENTS 3,303,598 2/1967 Spindler ..... 43/44.9
3,428,014 2/1969 Smith et al. ..... 114/305
4,014,478 3/1977 Bonacina ..... 441/26
4,501,563 2/1985 Johnson et al. ..... 441/6
4,601,126 7/1986 Klocksiem ..... 441/6
4,945,850 8/1990 Steinhoff ..... 114/304

*Primary Examiner*—Jesus D. Sotelo
*Attorney, Agent, or Firm*—E. Michael Combs

[57] ABSTRACT

An anchor organization for mounting to a float tube for positioning of the float tube relative to a body of water includes a support cable mounted to the float tube at a first end of the support tube, with a second end of the cable mounted to a semi-spherical anchor member arranged for engagement to a bottom surface of an associated body of water providing for an anchor of limited weight and increased effectiveness, wherein an intermediate spool mounted to the cable permits selective winding of the cable about the spool.

3 Claims, 4 Drawing Sheets

FIG. 8
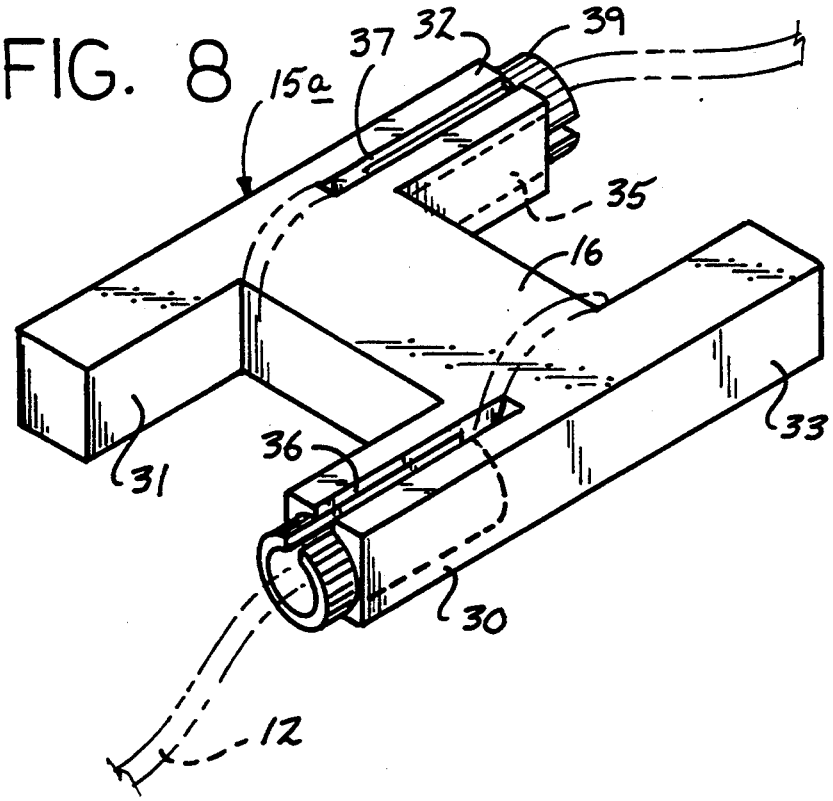
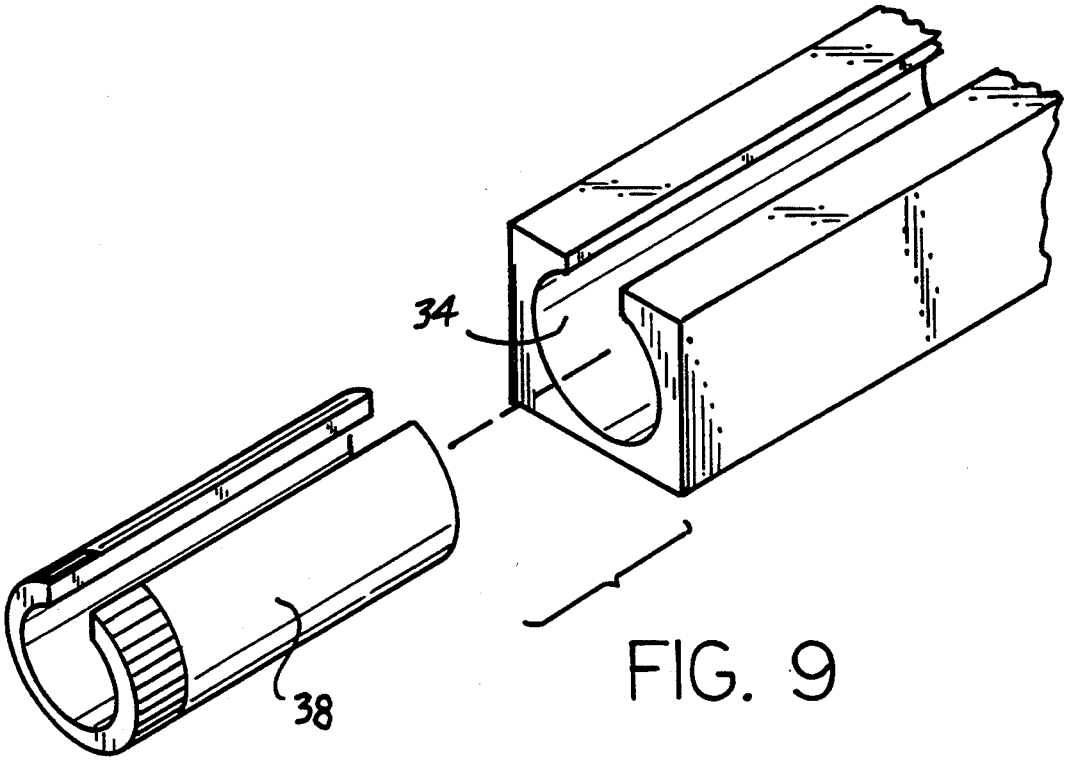
FIG. 9

FLOAT TUBE ANCHOR APPARATUS

BACKGROUND OF THE INVENTION

1. Field of the Invention

The field of invention relates to anchor apparatus, and more particularly pertains to a new and improved float tube anchor apparatus wherein the same is arranged for the effective positioning of a float tube relative to a body of water.

2. Description of the Prior Art

Anchors of various types have been utilized throughout the prior art such as exemplified in the U.S. Pat. Nos. 3,428,014 and 4,945,850.

The instant invention attepts to overcome deficiencies of the prior art wherein an anchor structure arranged for use with a float tube requires a limited weight in accomodating positioning of the float tube relative to a body of water and in this respect, the present invention substantially fulfills this need.

SUMMARY OF THE INVENTION

In view of the foregoing disadvantages inherent in the known types of anchor apparatus now present in the prior art, the present invention provides a float tube anchor apparatus wherein the same includes a semi-spherical anchor member arranged to engage a bottom surface of a body of water to effect positioning of a float tube relative to the body of water. As such, the general purpose of the present invention, which will be described subsequently in greater detail, is to provide a new and improved float tube anchor apparatus which has all the advantages of the prior art anchor apparatus and none of the disadvantages.

To attain this, the present invention provides an anchor organization for mounting to a float tube for positioning of the float tube relative to a body of water, including a support cable mounted to the float tube at a first end of the support tube, with a second end of the cable mounted to a semispherical anchor member arranged for engagement to a bottom surface of an associated body of water providing for an anchor of limited weight and increased effectiveness, wherein an intermediate spool mounted to the cable permits selective winding of the cable about the spool.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved float tube anchor apparatus which has all the advantages of the prior art anchor apparatus and none of the disadvantages.

It is another object of the present invention to provide a new and improved float tube anchor apparatus which may be easily and efficiently manufactured and marketed.

It is a further object of the present invention to provide a new and improved float tube anchor apparatus which is of a durable and reliable construction.

An even further object of the present invention is to provide a new and improved float tube anchor apparatus which is susceptible of a low cost of manufacture with regard to both materials and labor, and which accordingly is then susceptible of low prices of sale to the consuming public, thereby making such float tube anchor apparatus economically available to the buying public.

Still yet another object of the present invention is to provide a new and improved float tube anchor apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of a modified spool member of the invention.

FIG. 9 is an enlarged isometric illustration of a sleeve in operative association with the modified spool member, as indicated in FIG. 8.

DESCRIPTION OF THE PREFERRED EMBODIMENT

Figure 1:
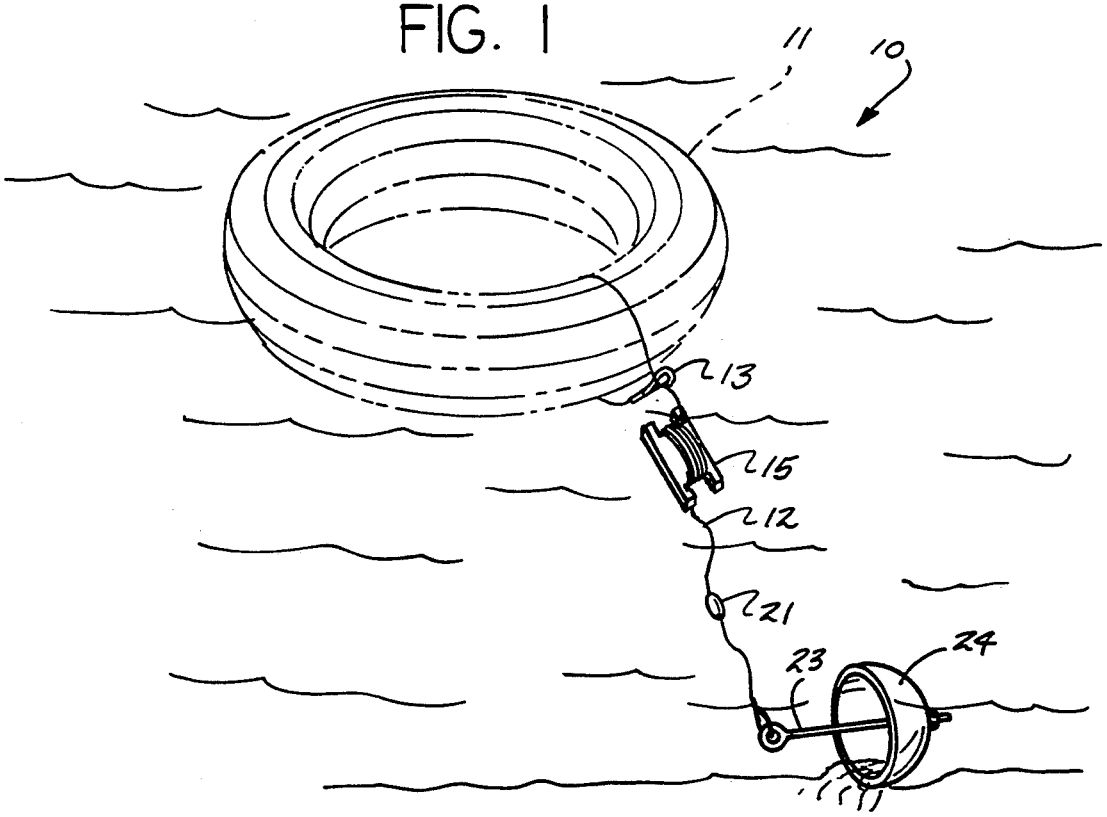
FIG. 1 is an isometric illustration of the invention in use.

With reference now to the drawings, and in particular to FIGS. 1 to 9 thereof, a new and improved float tube anchor apparatus embodying the principles and concepts of the present invention and generally designated by the reference numeral 10 will be described.

Figure 2:
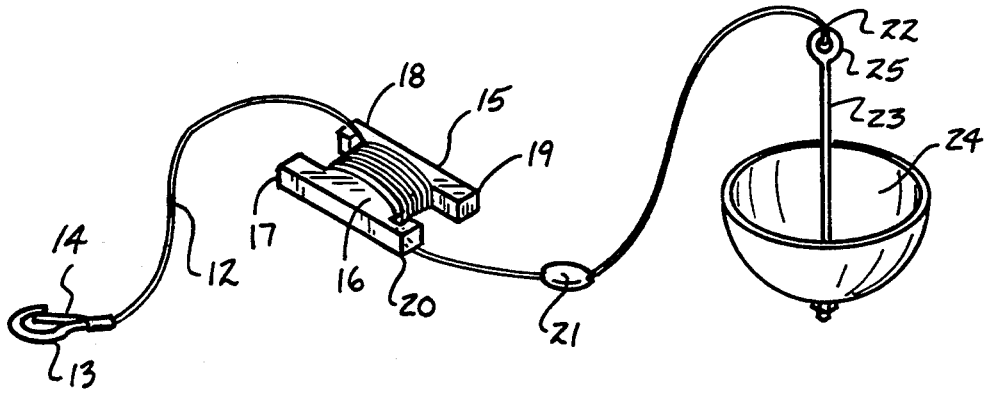
FIG. 2 is an isometric illustration of the invention.
Figure 3:
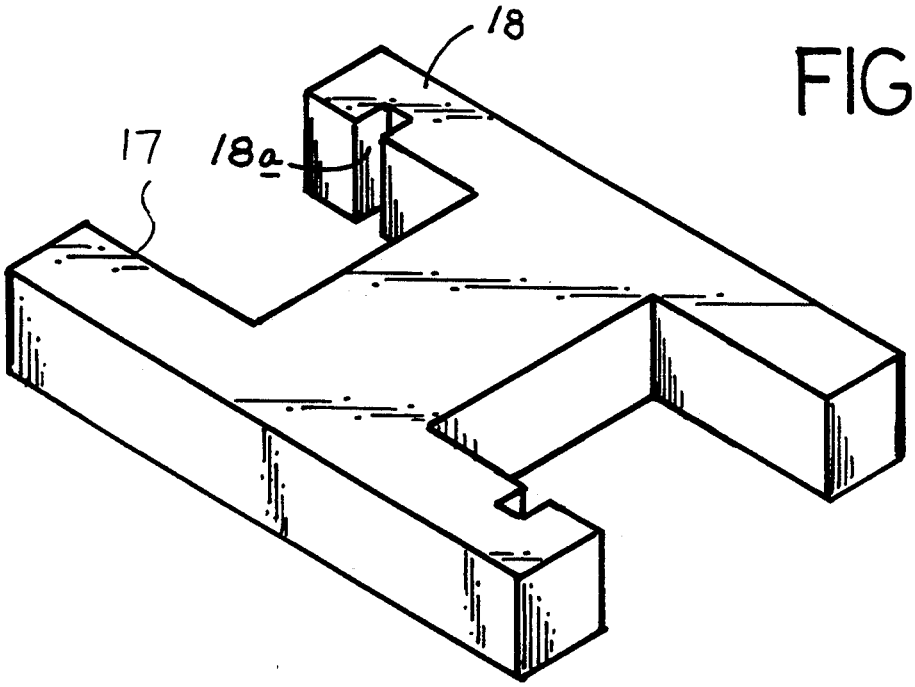
FIG. 3 is an enlarged isometric illustration of the spool member of the invention.
Figure 4:
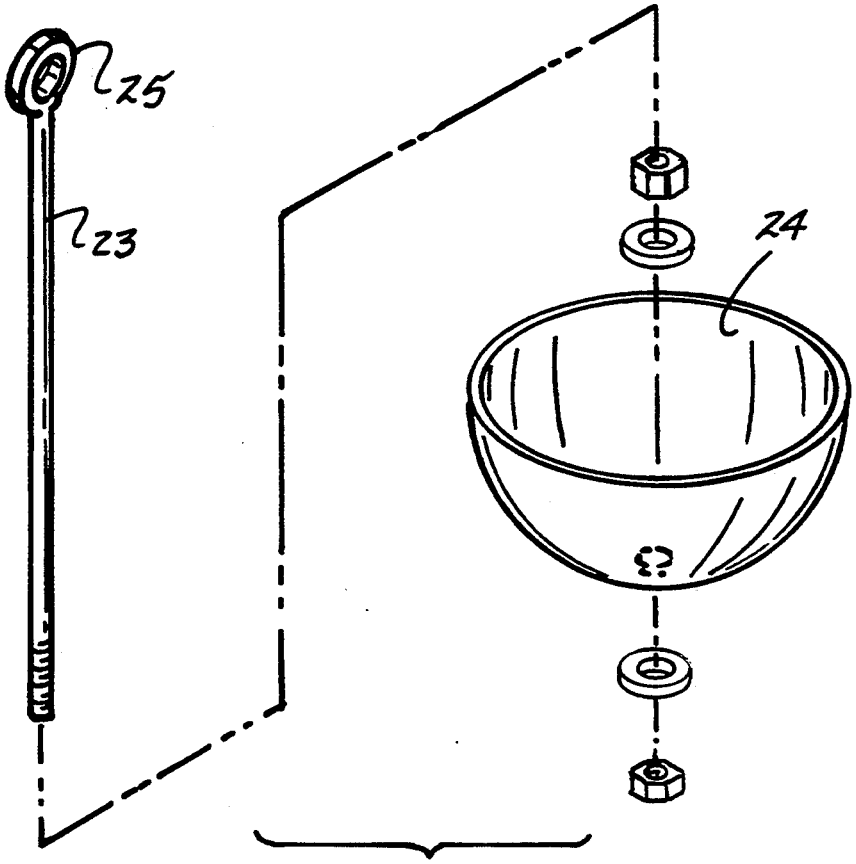
FIG. 4 is an isometric exploded view of the anchor portion of the invention.

More specifically, the float tube anchor apparatus 10 of the instant invention essentially comprises the positioning of a float tube 11, as indicated in FIG. 1, relative to a body of water, wherein a support cable 12 having a cable first end includes a first end hook member 13. The hook member 13 includes a spring plate 14 to form a closed loop in the biased communication of the spring plate relative to the hook member 13 permitting access within the enclosed loop upon displacement of the spring plate from the spring member 13, as the spring plate is anchored at one of its ends to the hook member base, as indicated in FIG. 2. A spool plate 15 is provided, having a central body plate portion 16, wherein a first end of the body plate 16 includes respective first and second parallel legs 17 and 18, with a second end of the body plate having third and fourth parallel legs 19 and 20. The second leg includes a second leg cable notch 18*a*, while the fourth leg includes a fourth leg cable notch 20*a*. As the cable is wound about the central body plate 16, the cable 12 adjacent the second and fourth cable notches 18*a* and 20*a* are directed into the cable notches for securement of the cable relative to the spool plate. A ballast weight 21 is mounted to the cable between the spool plate 15 and a support cable second end 22. The support cable second end 22 in turn is mounted to an anchor rod 23, or more specifically to the anchor rod guide loop 25 at a free distal end of the anchor rod 23, wherein a semi-spherical anchor dish 24 is secured at a remote end of the anchor rod 23 relative to the guide loop 25. In this manner, the anchor rod is coaxially mounted medially of the semi-spherical anchor dish 24, with the concave interior surface of the anchor dish 24 is a facing relationship relative to the guide loop 25. Accordingly, as the anchor dish is positioned upon a body of water bottom surface, as indicated in FIG. 1, engagement with that bottom surface is effected for use of the structure as an anchor, while a minimum of weight is required by the anchor permitting ease of transport of the anchor relative to the float tube 11.

Figure 5:
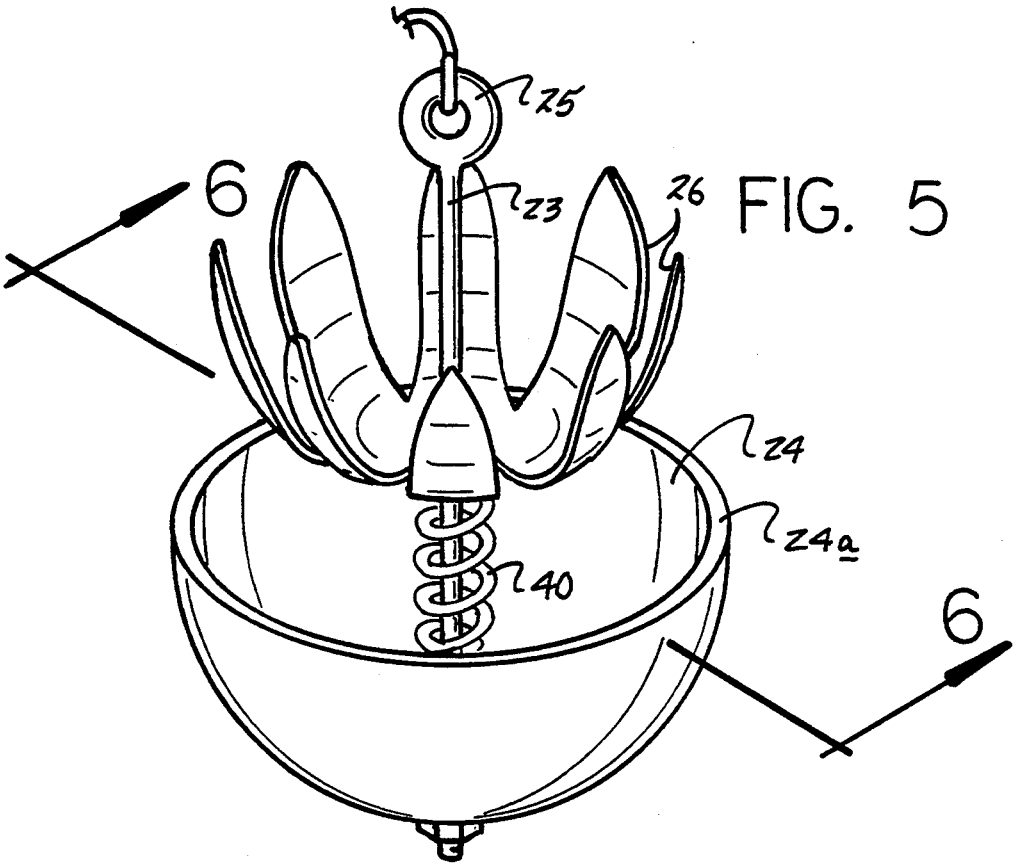
FIG. 5 is an isometric illustration of the anchor member having an additional engaging portion mounted in an extended orientation.
Figure 6:
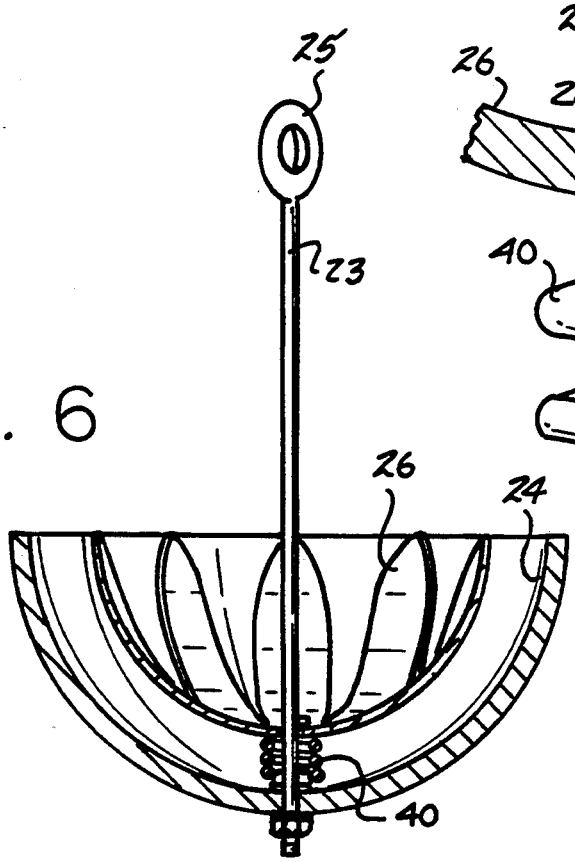
FIG. 6 is an orthographic view, taken along the lines 6—6 of FIG. 5, with the auxiliary engaging portion arranged in a nested orientation within the semi-spherical anchor.
Figure 7:
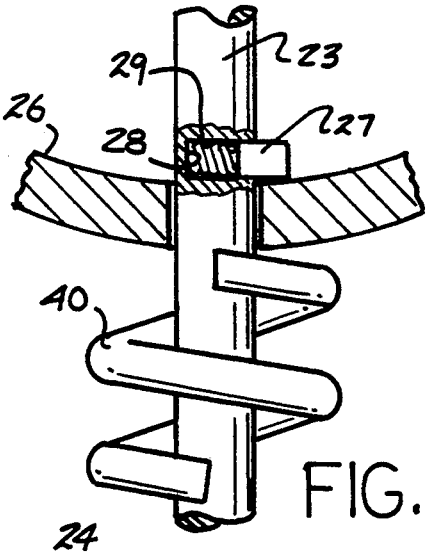
FIG. 7 is an enlarged orthographic view, partially in section, of the latch mechanism of the invention.

The FIGS. 5–7 indicates the use of a secondary anchor portion including secondary anchor legs 27 fixedly mounted relative to one another in a fixed semi-cylindrical array about the anchor rod 23 defining a concave interior surface at a facing relationship relative to the guide loop 25, with the anchor legs 26 slidably mounted relative to the anchor rod 23 between the anchor dish 24 and the guide loop 25. An anchor spring 40 is captured between the anchor legs 26 and the anchor dish 24, wherein a latch button 27 is reciprocatably mounted within a latch button cavity 28 directed into the anchor rod 23, with a latch button spring 29 captured between the latch button 27 within the latch button cavity floor, whereupon displacement of the latch button 27 against the spring 29 displaces the latch button 27 within the latch button cavity 28 permitting the anchor spring 40 to displace the secondary anchor legs 26 in a spaced relationship relative to the anchor dish annular periphery 24*a* to provide for a secondary scooping and anchoring of the organization within a body of water bottom surface.

The FIGS. 8 and 9 indicate the use of a modified spool plate 15*a*, having modified spool plate first and second parallel legs 30 and 31 extending at a first end of the spool plate, with third and fourth legs 32 and 33 parallel to one another at a second end of the spool plate, wherein a first leg channel 34 and a third leg channel 35 are arranged in a parallel offset relationship relative to one another projecting beyond the first and second respective ends of the spool plate, with the first leg channel third leg channel having respective first and second channel slots 36 and 37 directed through the first and third legs in communication with the first and third leg channels 34 and 35 in a coextensive relationship. Respective first and second split sleeves 38 and 39 are rotatably mounted within respective first and second third leg channels 34 and 35, whereupon as the cable 12 is received within respective first and third leg channels 34 and 35, the first and second split sleeves 38 and 39 having respective first and second sleeve slots rotate the first and second sleeve slots in a displaced orientation relative to the first and second channel slots 36 and 37 to thereby position the cable 12 within the first and third leg channels 34 and 35 to insure capture of the cable wound about the spool plate central body plate 16, in a manner as indicated in FIG. 1.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A float tube anchor apparatus, comprising, a support cable, the support cable having a first end spaced from a second end, and a hook member mounted to the first end, the hook member including a latch plate means for selective securement to the hook member for forming a closed loop within the hook member, and a semi-spherical anchor dish having an annular periphery, including an anchor rod, with the anchor rod having a rod first end spaced from a rod second end, the rod first end including a guide loop, with the rod second end fixedly mounted to the anchor dish medially of the anchor dish, with the anchor dish having a concave interior surface and facing relationship relative to the guide loop, and the cable second end secured to the guide loop, and a spool member, with the support cable wound about the spool member intermediate the cable first end and the cable second end, and a ballast weight mounted to the support cable intermediate the spool member and the cable second end, and the spool member includes a central body plate, having a plate first end spaced from a plate second end, with respective first and second parallel legs mounted to the plate first end, and third and fourth parallel legs mounted to the plate second end, and the first leg includes a first leg channel, and the third leg having a third leg channel, with the first leg channel and the third leg channel arranged in a spaced parallel relationship relative to one another, with the first leg including a first channel slot directed into the first leg in communication with the first leg channel, the third leg having a second channel slot directed into the third leg channel, and a first split sleeve rotatably mounted within the first leg channel, and a second split sleeve rotatably mounted within the third leg channel, with the cable arranged through the first leg channel and the third leg channel received within the first split sleeve and the second split sleeve, the first split sleeve having a first sleeve slot arranged for rotatable displacement relative to the first channel slot, and the second split sleeve having a second sleeve slot arranged for displacement relative to the second channel slot.

2. An apparatus as set forth in claim 1 including a secondary anchor member mounted to the anchor rod, with the secondary anchor member including a fixed semi-spherical array of leg members symmetrically mounted about the anchor rod, wherein the secondary anchor member includes a secondary anchor member concave surface in facing relationship relative to the anchor rod guide loop, and latch means for securement of the secondary anchor member in a first position between the anchor dish annular periphery and displaced in a second position between the annular periphery and the guide loop.

3. An apparatus as set forth in claim 2 wherein the latch means includes a latch button reciprocatably mounted relative to the anchor rod orthogonally oriented relative to the anchor rod, and a latch button cavity directed into the anchor rod reciprocatably receiving the latch button, with a latch button spring captured between the latch button and the cavity, whereupon displacement of the latch button within the latch button cavity permits displacement of the secondary anchor member to the second position, and an anchor spring captured between the secondary anchor member and the anchor dish for biased displacement of the secondary anchor member from the first position to the second position.

* * * * *